US006171015B1

(12) United States Patent
Barth et al.

(10) Patent No.: US 6,171,015 B1
(45) Date of Patent: Jan. 9, 2001

(54) ANCHORING OF OUTDOOR TRAFFIC AREAS PROVIDED WITH COBBLESTONES OR PAVING STONES

(75) Inventors: Gunter Barth, Buhlertal; Michael Schmitz, Weitenung, both of (DE)

(73) Assignee: F. Von Langsdorff Licensing Limited, Ontario (CA)

( * ) Notice: Under 35 U.S.C. 154(b), the term of this patent shall be extended for 0 days.

(21) Appl. No.: 08/887,675

(22) Filed: Jul. 3, 1997

(30) Foreign Application Priority Data

Jul. 5, 1996 (DE) ..... 196 27 087

(51) Int. Cl.[7] ..... E01C 5/06; E01C 3/06
(52) U.S. Cl. ..... 404/34; 404/37; 404/43
(58) Field of Search ..... 404/18, 34, 73, 404/37, 38, 40, 45, 43; 52/386, 387, 388, 518; 33/526, 52.74

(56) References Cited

U.S. PATENT DOCUMENTS

| | | | | |
|---|---|---|---|---|
| D. 97,318 | | 10/1935 | Galliano | 404/34 |
| 150,710 | | 5/1874 | Prindle . | |
| 222,025 | * | 11/1879 | Devilliers | 404/28 |
| 285,746 | * | 9/1883 | Gates et al. | 404/31 |
| D. 317,208 | | 5/1991 | Scheiwiller | D25/113 |
| 479,126 | | 7/1892 | See | 404/18 |
| 1,864,153 | | 6/1932 | Solon | 404/73 |
| 1,877,481 | | 9/1932 | Prouty | 404/73 |
| 1,953,657 | * | 4/1934 | Pierce | 404/73 |
| 2,101,019 | | 12/1937 | Bowes | 404/34 |
| 2,162,777 | | 6/1939 | Hagopain . | |
| 2,388,880 | | 11/1945 | Stitt | 404/73 |
| 2,710,335 | | 6/1955 | Wong | 404/73 |
| 3,270,473 | | 9/1966 | Smith | 404/73 |
| 3,875,716 | | 4/1975 | Eusemann | 404/18 |
| 3,891,340 | * | 6/1975 | Bolli | 404/34 |
| 4,544,305 | | 10/1985 | Hair | 404/34 |
| 4,583,341 | | 4/1986 | Barth et al. | 52/589 |
| 4,722,158 | | 2/1988 | Urdaneta | 52/316 |
| 4,773,790 | | 9/1988 | Hagenah | 404/41 |
| 5,238,721 | * | 8/1993 | Nakazwa | 52/386 |
| 5,323,575 | * | 6/1994 | Yeh | 52/386 |
| 5,342,141 | * | 8/1994 | Close | 404/28 |
| 5,418,036 | * | 5/1995 | Tokikawa et al. | 52/386 |
| 5,470,623 | * | 11/1995 | Lucas | 52/311.2 |
| 5,761,867 | * | 6/1998 | Carling | 52/386 |

FOREIGN PATENT DOCUMENTS

| | | |
|---|---|---|
| 670640 | 10/1964 | (BE) . |
| 481270 | 11/1969 | (CH) . |
| 1529299 | 6/1968 | (FR) . |
| 2398142 | 7/1977 | (FR) . |
| 500880 | 11/1954 | (IT) . |
| 3-247802 | 11/1991 | (JP) . |

OTHER PUBLICATIONS

Architectural Records, Product Reports, Jul. 1957.
J. American Concrete Institute, "Plastic Forms for Architectural Concrete," May 1960.
1981 Sweet's Catalog Section 9.18 EL, p. 4.
Sep. 1984 Patterns Section #2000, p. 10.
Bild 4.1.22: Patchwork Quilt by Jinny Bayer.
Bild 3.3.19: Patchwork Quilt by Jinny Bayer.
Pictoral Concrete Powers, Aug. 1979.

* cited by examiner

*Primary Examiner*—Eileen D. Lillis
*Assistant Examiner*—Raymond W. Addie
(74) *Attorney, Agent, or Firm*—Orrick, Herrington & Sutcliffe LLP

(57) ABSTRACT

An anchoring of outdoor traffic areas provided with cobblestones or paving stones made of a plastic or natural stone material is cited, in which the stones are laid in a bed of sand and/or grit. The anchoring method provides for the stones to be further supported by an extensive supporting structure provided with openings and laid on top of the bed.

9 Claims, 9 Drawing Sheets

ANCHORING OF OUTDOOR TRAFFIC AREAS PROVIDED WITH COBBLESTONES OR PAVING STONES

An anchoring of outdoor traffic areas provided with cobblestones or paving stones made of a plastic or natural stone material is cited, in which the stones are laid in a bed of sand and/or grit. The anchoring method provides for the stones to be further supported by an extensive supporting structure provided with openings and laid on top of the bed.

The invention relates to anchoring of outdoor traffic areas provided with cobblestones or paving stones made of a plastic or natural stone material, in which the stones are laid in a bed of sand and/or grit referred to herein as "sand bedding".

In such anchoring, the sand bedding forms the foundation for the paving stones and consists of the leveled and compacted soil with a sub-base or non-freezing layer provided on top.

The foundation thus constructed constitutes a firm support for the stones which, particularly with specially-shaped stones or appropriate dimensioning of the gaps between the stones, is also capable of diverting accumulated surface water.

However, there is a problem with regard to the durability of such a stone surface in conditions of recurring high localized loads, as they are unavoidable even in pedestrian areas, particularly through particularly in areas used by heavy motor vehicles these areas. The relatively small contact surfaces of vehicle wheels, when driving over the stones, exert tilting forces on the latter and these forces can assume a high value particularly during vehicle acceleration. Furthermore, the stones are also subject to torsional forces about an axis perpendicular to their laying plane for example by the vehicle's steering mechanism being actuated at slow speed or even when stationary.

The load profile thus outlined can lead to the stones gradually losing their solid position and no longer having a level supporting surface in their sand bedding, this phenomenon capable of being significantly intensified by surface water continuously penetrating the surface particularly in conjunction with frost. In the end, the stones no longer lie level with each other and can tilt on their foundation. This leads to the development of uneven edges and breaking up of individual stones, such a risk of fracture existing in particular for paving stones because of their unfavorable depth-to-length ratio.

In fact numerous forms of stones are known which, due to their peripheral profile, are capable of distributing such forces to adjacent stones. Such "coupled stones" are frequently employed with good results for example in the field of industrial spaces; however these often do not meet the enhanced requirements for a pleasing design of surfaces in the urban and private sector. In that case, cobbles and paving stones are frequently preferred in rectangular or square format for visual reasons.

In the case of the loads described above, measures to lay such stones in a mortar bed cannot be regarded as a lasting solution, since frost and the use of thawing salt gradually destroy this bedding. Also it has been shown that thermal influences as well as translatory and slewing movements of vehicles cause instability in the road surface.

On the basis of this, the purpose of the invention is to design an anchoring method of the type mentioned at the start, so that increased durability and permissible loading of the road surface is achieved with use of stones with rectangular or square format in particular.

This task is achieved according to the invention in that the stones are further supported by an extensive supporting structure provided with openings and laid on top of the bed.

Compared with the sand bedding, this measure according to the invention has the effect that the stones have a practically rigid support against localized loads and the tilting movements caused by them, at the same time good dissipation of the locally occurring forces being combined with support.

By providing the supporting structure with openings, it can work its way well into the sand bedding with vibratory motion so that the stones remain supported by the sand bedding in the usual way in the region of the openings. On the other hand, the desired drainage of surface water is not impaired, thanks to the openings.

With all that, it will be appreciated that the design size of the supporting structure is selected so that the supporting structure locally has a cross-section of satisfactory load-bearing capacity, and therefore sufficient supporting surface for the stones, and is inherently very stable, though on the other hand contains no accumulation of material exceeding the necessary size.

According to the invention, there is provided an additional structural member which provides a supporting surface easily spread out on the prepared sand bedding before the stones are laid. On the other hand, the stones at this point can be formed in principle as simple plain cuboids so that aesthetic requirements are permanently met in the field of highly-loaded surfaces. The stability obtained in the road surface and the saving thus achieved in repair costs compensate by far for the additional expenditure attributed to the supporting structure.

With certain designs of the supporting structure according to the invention, the other common boundary reinforcement by curbstones and the like can be dispensed with, which leads to a further increase in economy.

Even if in principle no special requirements, with the exception of the above-mentioned design criteria, have to be made for the design of the supporting structure according to the invention, then it has proved to be advantageous to design the supporting structure as a support grating, since it is produced in this form particularly conveniently for example as continuous material and also with regard to the design of its grating structure, the size can be matched to the stones to be laid. In that connection, care is to be taken that the mesh of the grating formed by adjacent openings corresponds at best to the smallest size of the cobbles to be laid.

It is advantageous if the supporting structure is formed by intersecting rod-shaped or strip-shaped profiles which are usefully joined together at their points of intersection to form one piece, therefore the intersections do not extend beyond the surface plane. At the same time, depending on the circumstances in individual cases, provision can of course be made for each of the profiles to be arranged at least in pairs parallel with one another.

In the form described, the supporting structure can consist of steel, reinforced concrete, recycled plastic or other corrosion-resistant material, a recycled plastic being preferred. Then such supporting structures can subsequently be spread out together in the form of matting, it even being possible to wind supporting structures manufactured from plastic as a continuous product onto a drum, so that they can be drawn off in continuous lengths when laying the supporting members.

If one starts from a supporting structure with a grating design, then the relative position between the supporting structure and stones can be chosen so that either the stones are located in position with their bottom surface on the supporting structure, at least in the area of the periphery, or the stones are located in position with their bottom surface at least on one point of intersection of the profiles and the profile section following it. Of course, combinations of the two types can also be considered here.

As an improvement in the object of the invention and in order to give the stones additional positional security and to facilitate the orderly laying of the stones, provision can be made for the stones to be at least indirectly in positive engagement with the supporting structure. There are various possibilities for this.

Firstly, provision can be made for the bottom of the stones to be equipped with recesses for partial engagement with the supporting structure. These recesses can be for example grooves on the bottom of the stones, the said grooves matching the grating design of the supporting structure. However, the supporting structure can also be provided with formed parts on its upper surface for engagement in the corresponding recesses on the bottom of the stones.

Secondly, it is also possible for the supporting structure to be provided with formed parts on its upper surface for engagement in the gap between adjoining laid stones. This arrangement also acts as an accurate positioning tool and bracing against rotational movement, by which at the same time an accurate design size can be predetermined.

The formed parts of the kind mentioned can be integrally connected to the supporting structure, however it is also possible that the formed parts can be inserted into corresponding recesses in the supporting structure or can be attached to the profile sections of the supporting structure. In this case it is advantageous if the formed parts can be moved with regard to their insertion position at least within limits on the supporting structure, so that in this way it is possible to make a slight correction for dimensional variations in the stones.

As far as the height of the formed parts is concerned, it can be a fraction of the height of the stone. However, it is also possible that the formed parts extend at least almost to the upper edge of the stones so that they can be used as a framing element. At the same time, corresponding recesses of individual or adjoining stones also can be filled by the formed parts.

With such formed parts, further provision can also be made for them to have through recesses or openings through their entire height so that in this way they help to divert surface water.

With regard to the inclusion of the formed parts as a structural element of the road surface, it is now possible for other material, for example metal, to be used for the formed parts, that is to say for the supporting structure, so that in this way a particular property can be given to the road surface.

According to another concept within the scope of the invention, the supporting members can be provided with spike-like extensions on their lower surface or the formed parts can protrude through the lower surface. In this way it is possible to anchor the supporting members in the sand bedding and in addition possibly even in the sub-base, in order to thus contribute even further to the positional stability of the stone road surface.

As far as the joint between adjacent elements of the supporting structure is concerned, provision can also be eventually made here so that the elements are positively connected to one another by clamp-shaped parts, by adhesive bonding or by welding. This prevents unintended mutual displacement during laying operations and as well the road surface is stabilized in its entirety.

Further fundamental characteristics and details of the invention will follow from the subsequent description of the forms of design which are represented in the drawings, in which FIGS. 1 to 3 show various design forms of a support grating with stones laid upon it;

Figure 1:
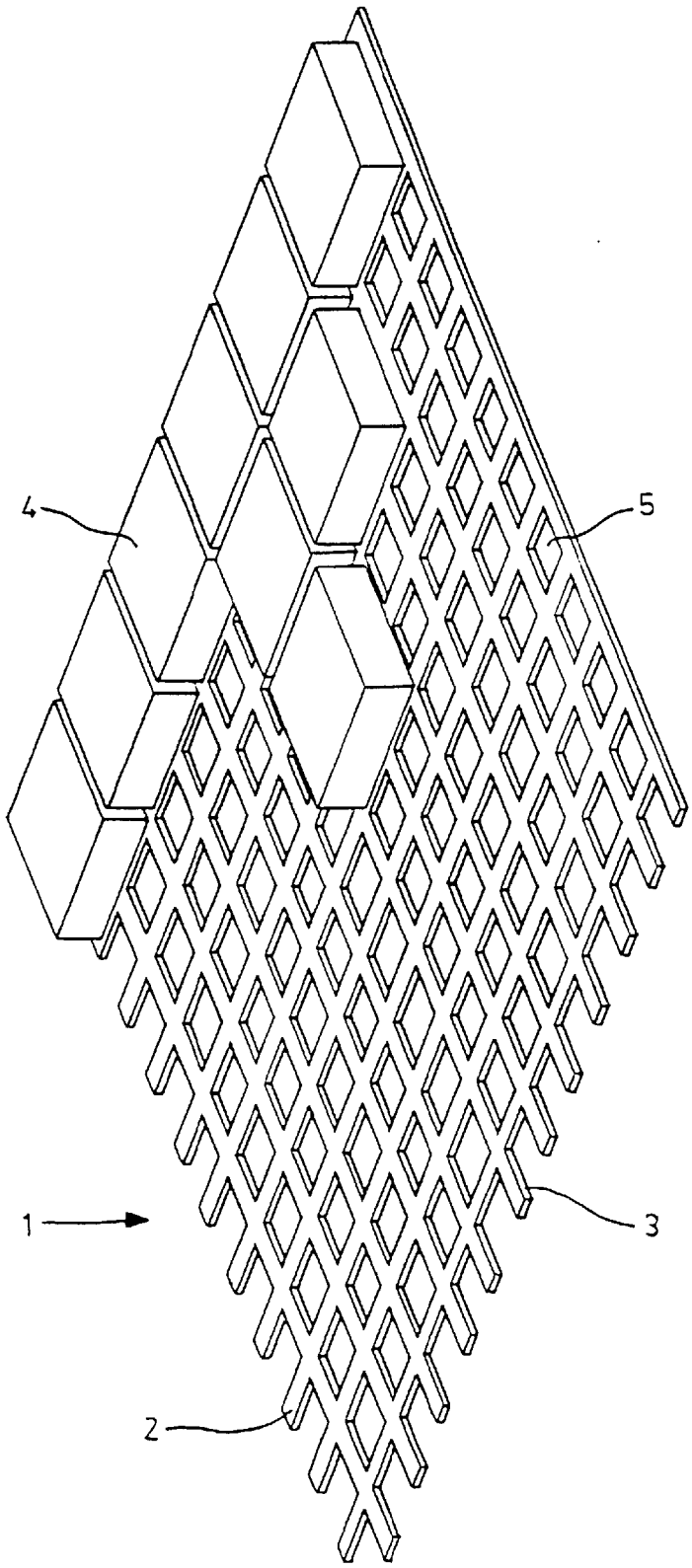

FIG. 1 shows a latticed support structure 1 made from strips 2, 3 arranged crosswise on top of each other. The supporting structure 1 can for example be manufactured from recycled plastic as a continuous material, from which the required matting can be easily cut off.

If the supporting structure 1 is laid on a sand bedding (not shown), it can then be covered with stones 4. When this operation is completed, then the supporting structure 1 and stones 4 are jointly vibrated into the sand bedding in a way known in the art, as a result of which, the supporting structure becomes embedded within the sand bedding material.

Figure 2:
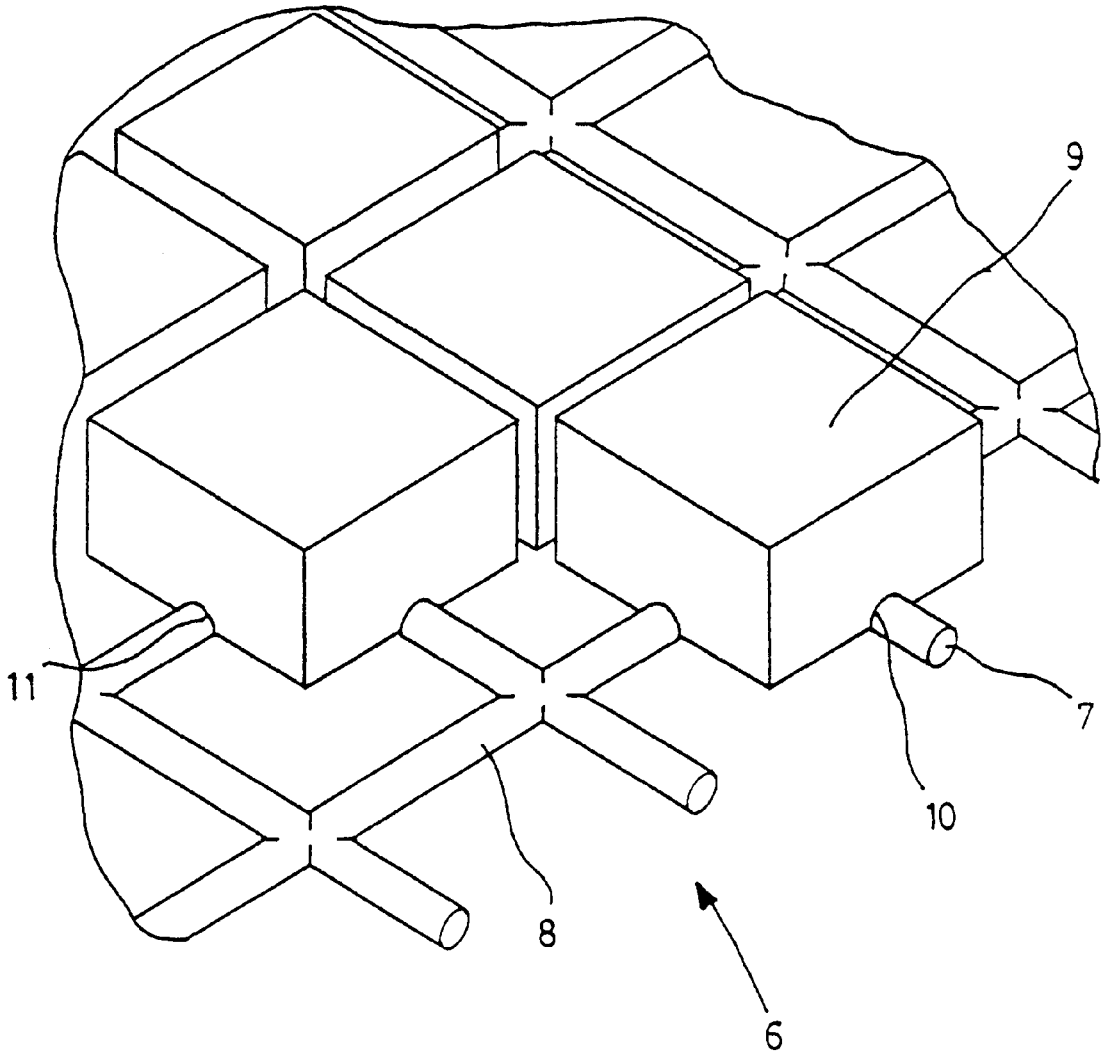

As is obvious, the supporting structure 1, in combination with the planar dimension of the stones 4, is designed and dimensioned so that the stones are supported around their periphery by strips 2, 3 and also rest on a strip intersection with the remainder of their bottom surface. As well, the dimensioning of the strips 2, 3 is chosen so that they ensure adequate support for the stones 4 and in this case adjacent stones can be supported with each of their adjoining edges on a common section of the strips 2, 3. In order to ensure this, the strips can have a thickness of 3 mm and a width of 20 mm for example FIG. 2 shows a latticed support structure 6 made of intersecting rods 7, 8. Also this supporting structure can consist of recycled plastic. However, it can also be formed as a steel matting.

Stones 9 are laid on the supporting structure 6, the stones 9 being provided on their bottom surface with intersecting grooves or channels 10, 11 so that each of them can be positively locked in place at a point of intersection of the rods 7, 8. With this, accurate positioning of the individual stones 9 can be predetermined by means of the design of the supporting structure 6 and the stones are protected against tilting, displacement and rotation after laying.

Figure 3:
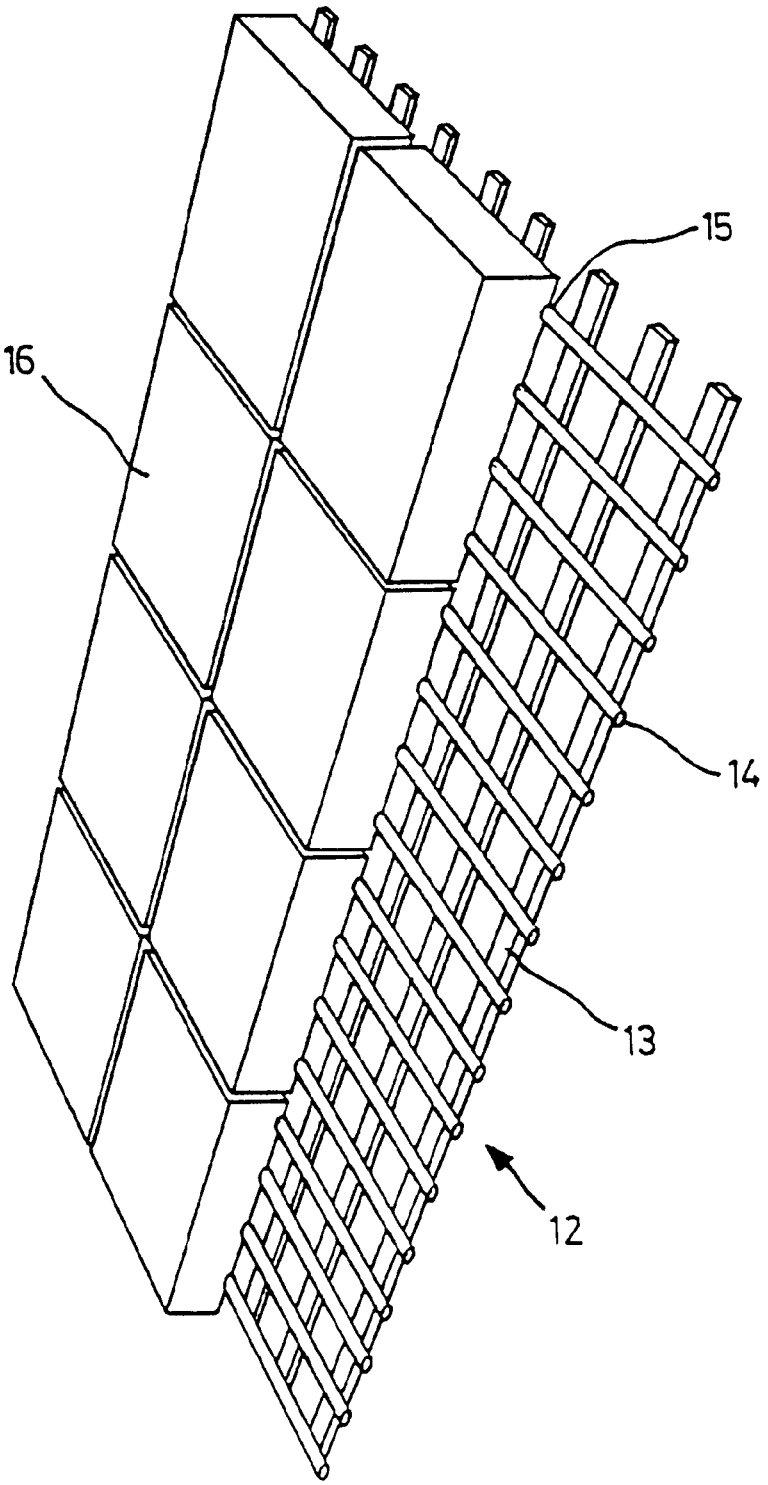

FIG. 3 shows a supporting structure 12, which represents a combination of the supporting structures represented in FIGS. 1 and 2. In this case, strips 13 lie at regular intervals and parallel to each other and are crossed at right-angles by rods 14 arranged likewise parallel to each other. The rods 14 can project upwards through the plane of the strips 13 and their matching grooves 15 on the bottom surface of the stones 16 can be coordinated so that in this case as well the stones 16 are positively engaged with the supporting structure 12.

As shown in FIG. 3, the grating design of the supporting structure 12 can be accurately designed for slab-shaped stones 16 so that the bottom surface of the stones 16 is supported over several strips 13 and rods 14.

Figure 4:
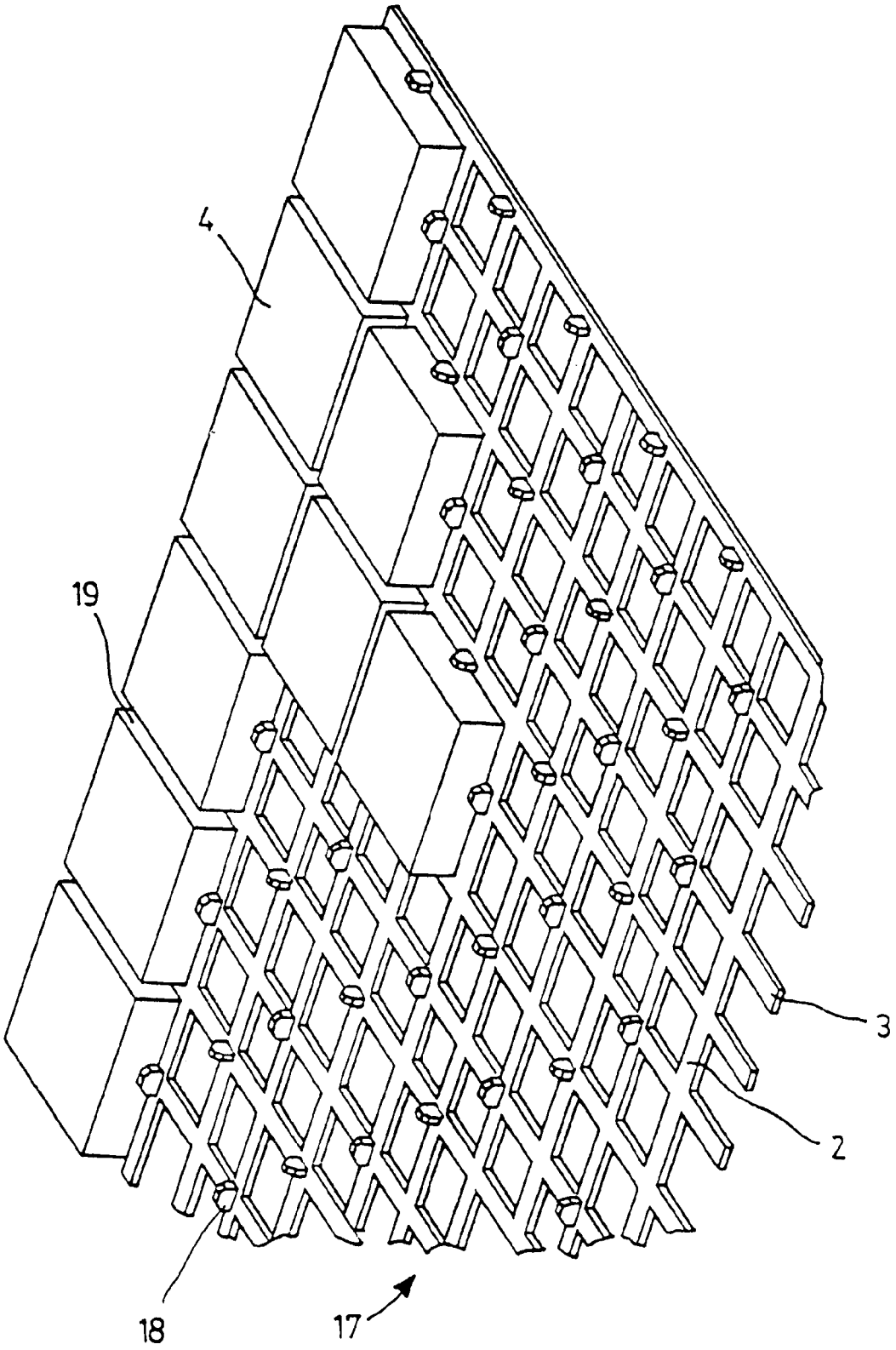
FIG. 4 shows a variation in the object according to FIG. 1.

With the supporting structure 17, FIG. 4 shows a variation in the supporting structure 1 according to FIG. 1 to the effect that formed parts 18 with a rectangular horizontal cross-section are arranged on the strips 2, 3 at the points of intersection in such a way that each of the stones 4 are clearly seated between the formed parts 18 facing each other. A positive lock also is produced in this way between the stones 4 and the supporting structure 17. The formed parts provide for a defined gap 19 which remains constant with traffic and therefore prevent damaging compression of the stones. By means of the dimensioning of the formed parts 18, the width of the gap 19 provided between adjacent stones also can be fixed in order to obtain for instance a drainage gap for water seepage Perpendicular to the respective sides of the stones 4, the formed parts 18 obviously have a thickness which is less than the width of the strips 2, 3, therefore still sufficient strip width remains for supporting the stones 4 along the periphery. In the case depicted, the formed parts 18 firmly connected to the supporting structure 17, which can be easily done during its series production.

Figure 5:
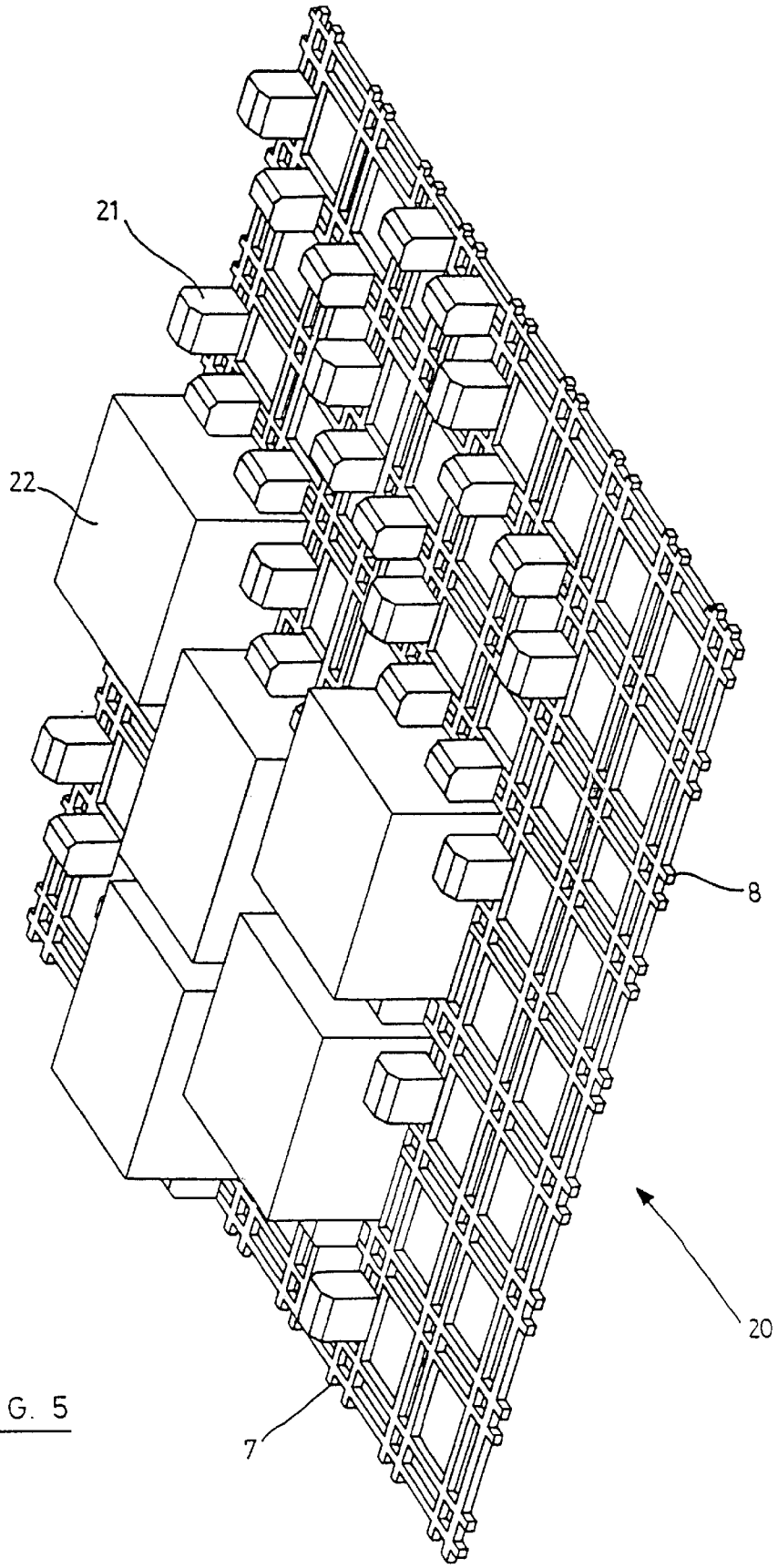
FIG. 5 shows a variation in the object according to FIG. 4.

In comparison with the previous case, FIG. 5 shows, in a variation of the object according to FIG. 4, a supporting structure 20 with pairs of rods 7, 8 arranged parallel to each other, in whose interstice formed parts 21 are inserted by means of rectangular cross-section pegs formed on their bottom. In this case, the formed parts therefore can be fitted during the laying operation and make it possible, as is apparent from FIG. 5, to control the laying pattern of the stones 22. In this case, the stones can have a smooth bottom surface, since they are positioned with a previously determined mutual spacing by the formed pieces 21.

Figure 6:
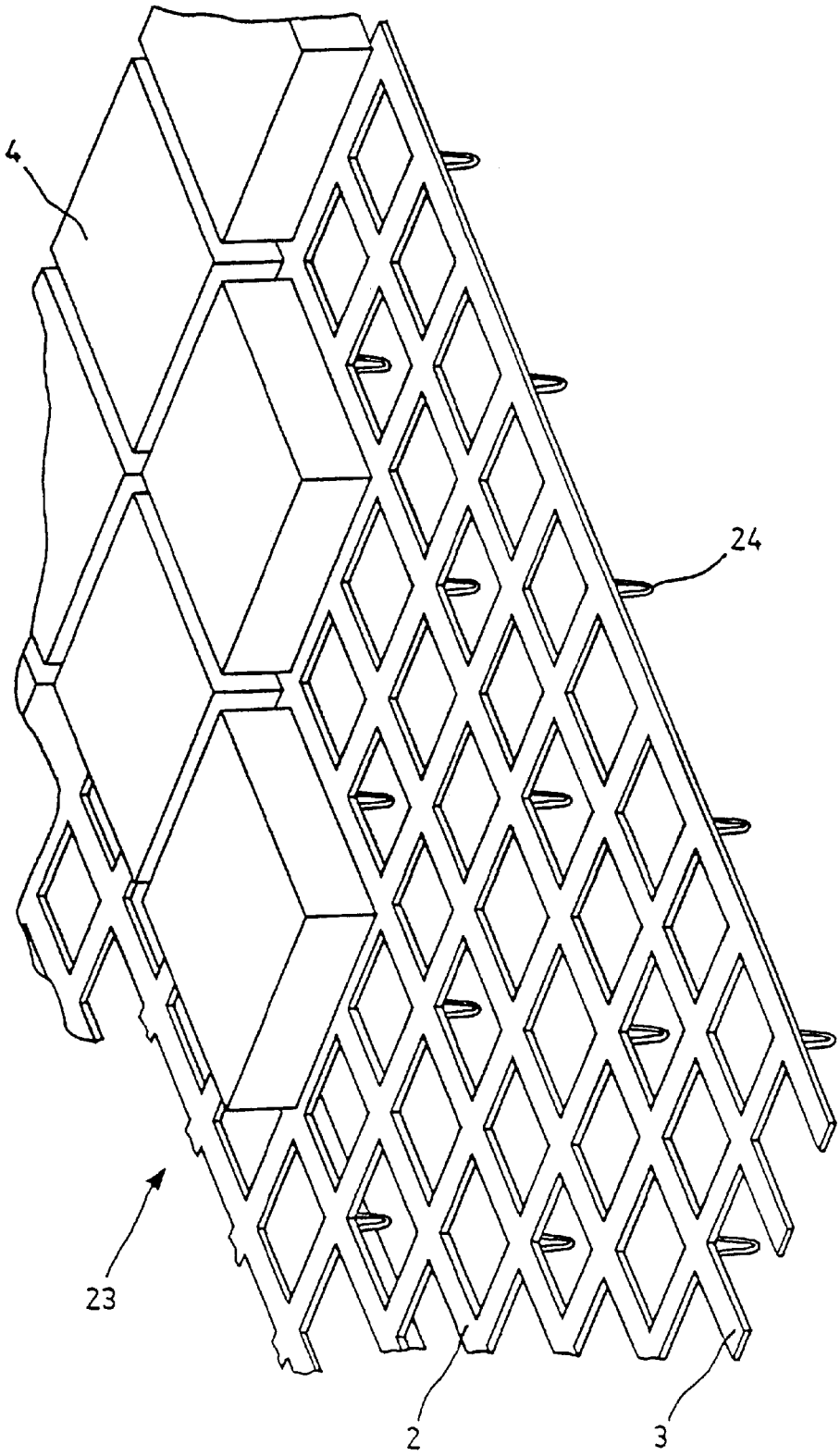
FIG. 6 shows a further variation in the object according to FIG. 1.

With the supporting structure 23, FIG. 6 shows a variation in the supporting structure 1 according to FIG. 1 to the effect that spike-like extensions 24, which serve as additional anchoring of the supporting structure 23 in the sand bedding or even in the sub-base, are now provided on the bottom surface at the intersections of the strips 2, 3.

With reference to the example according to FIG. 6, corresponding spike-like formed parts also can be produced on the top surface of the supporting structure 23 so that they can engage in recesses in the bottom surface of the stones 4 in order to establish a positive lock between the supporting structure 23 and stones 4.

Figure 7:
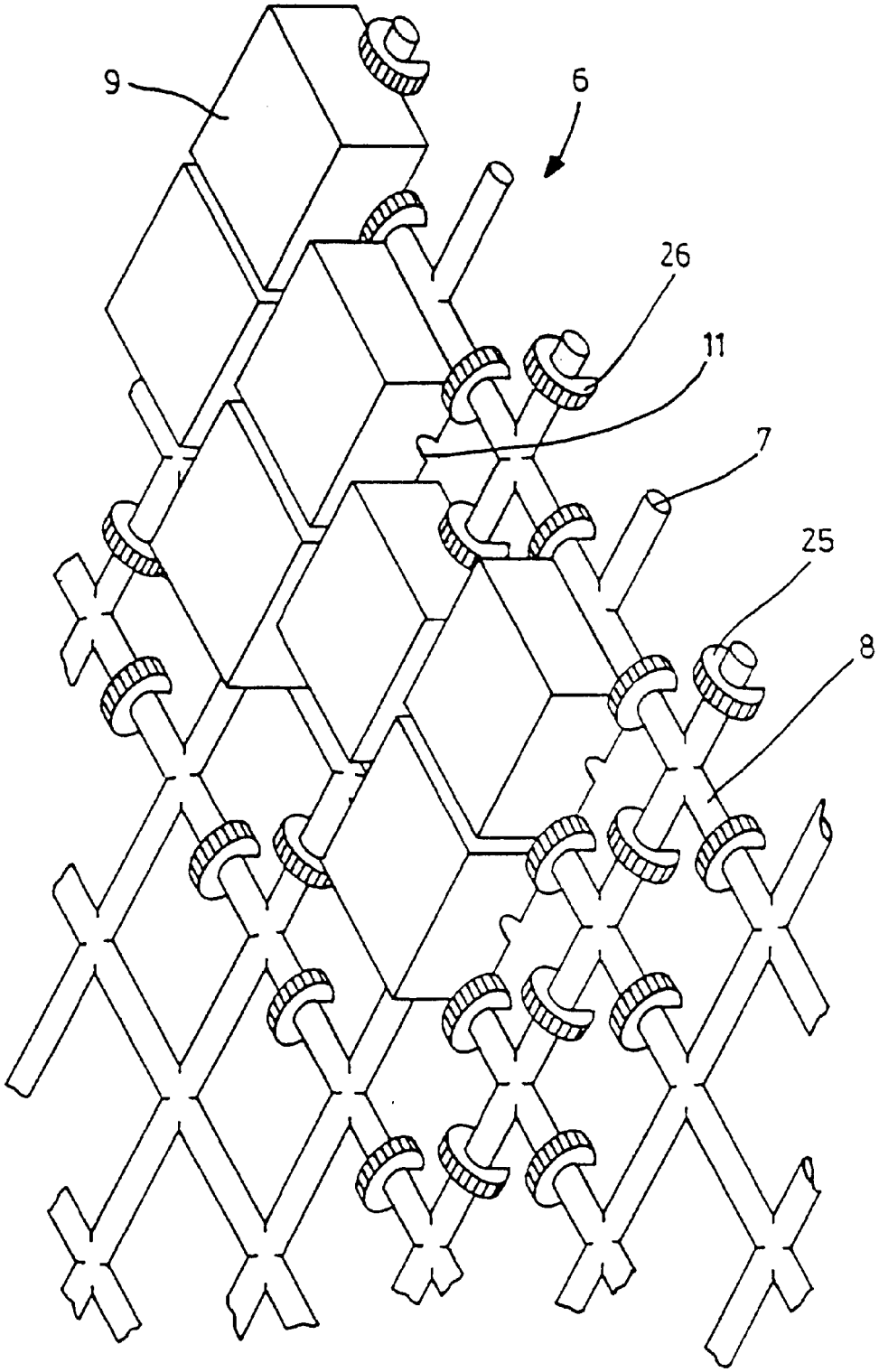
FIG. 7 shows a further variation in the object according to FIG. 2.

Starting from the structural shape according to FIG. 2, FIG. 7 shows disc-shaped formed parts 25 which are attached to the rods 7, 8 by means of a slot 26 so that they fix the mutual spacing of adjacent stones 9 and additionally at the same time fix the stones in their positive lock with the supporting structure 6 via the stone profiling 11 As well, the formed pieces 25 can be moved on the rods 7, 8 so that dimensional tolerances are evened out during the laying of the stones 9. At the same time, the formed parts 25 provide for fixing of the supporting structure in the sand.

Figure 8:
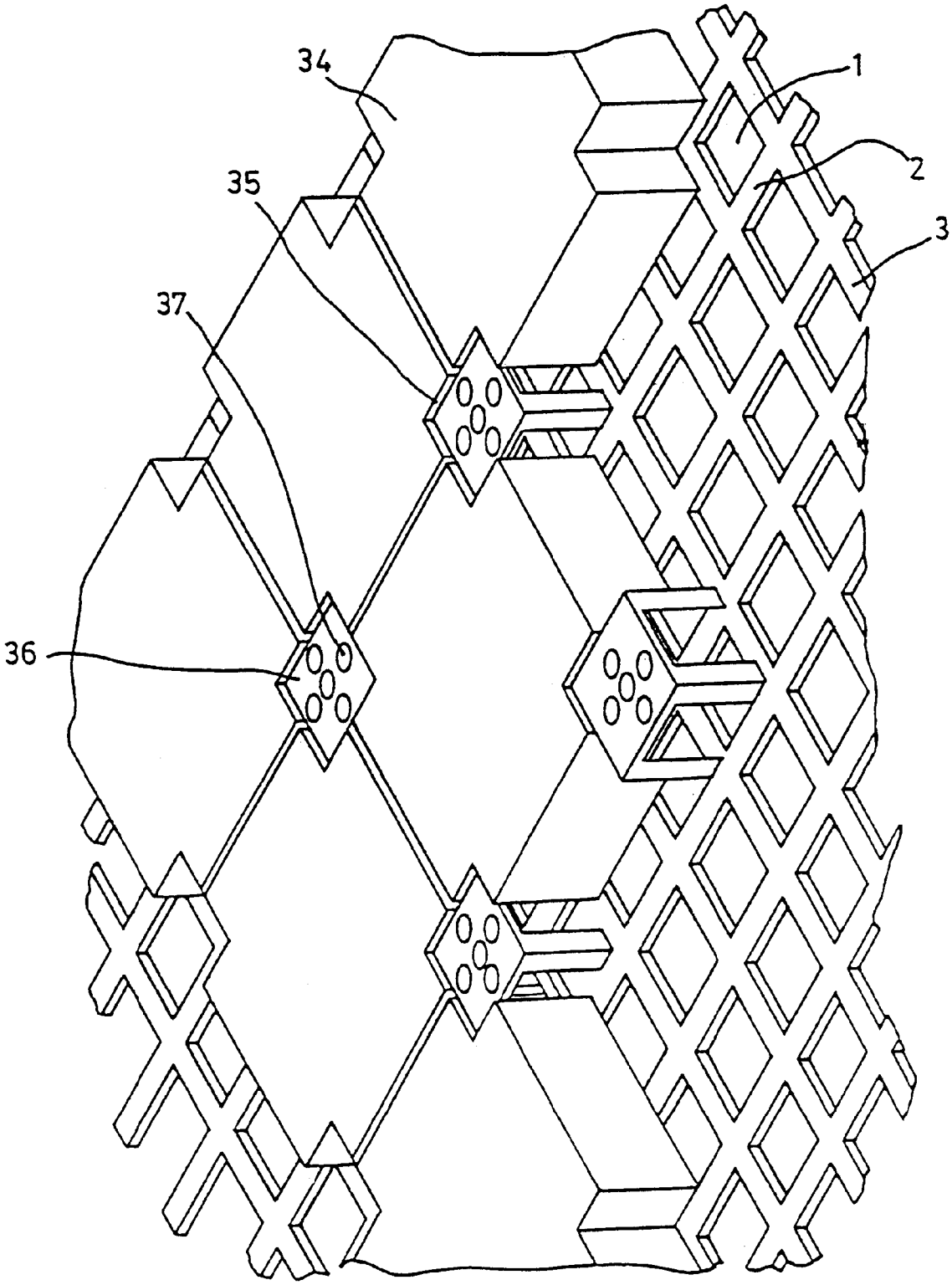
FIG. 8 shows a further variation in the object according to FIG. 1.

Starting from the form of design according to FIG. 1, FIG. 8 in turn shows a supporting structure 1 with stones 34 laid on it, the stones being in engagement with formed parts 36 corresponding to recesses 35 at the corners of the stones.

In this example, the formed parts take the form of open cubic hollow bodies which can be connected either to the supporting structure 1 or else can also be inserted in openings in the strips 2, 3 in a way not shown in detail.

In the last-mentioned case, it is possible to manufacture the formed parts 36 from a material differing from the supporting structure 1, metal for example, in order to thereby add to or to affect structurally the road surface formed by the stones 34.

As is obvious from the representation, starting from their top surface the formed parts 36 have recesses or openings 37 as well which go through the entire depth of the formed parts 36 so that the formed parts can contribute further, and in a particular way, to the drainage of accumulating surface water.

Figure 9:
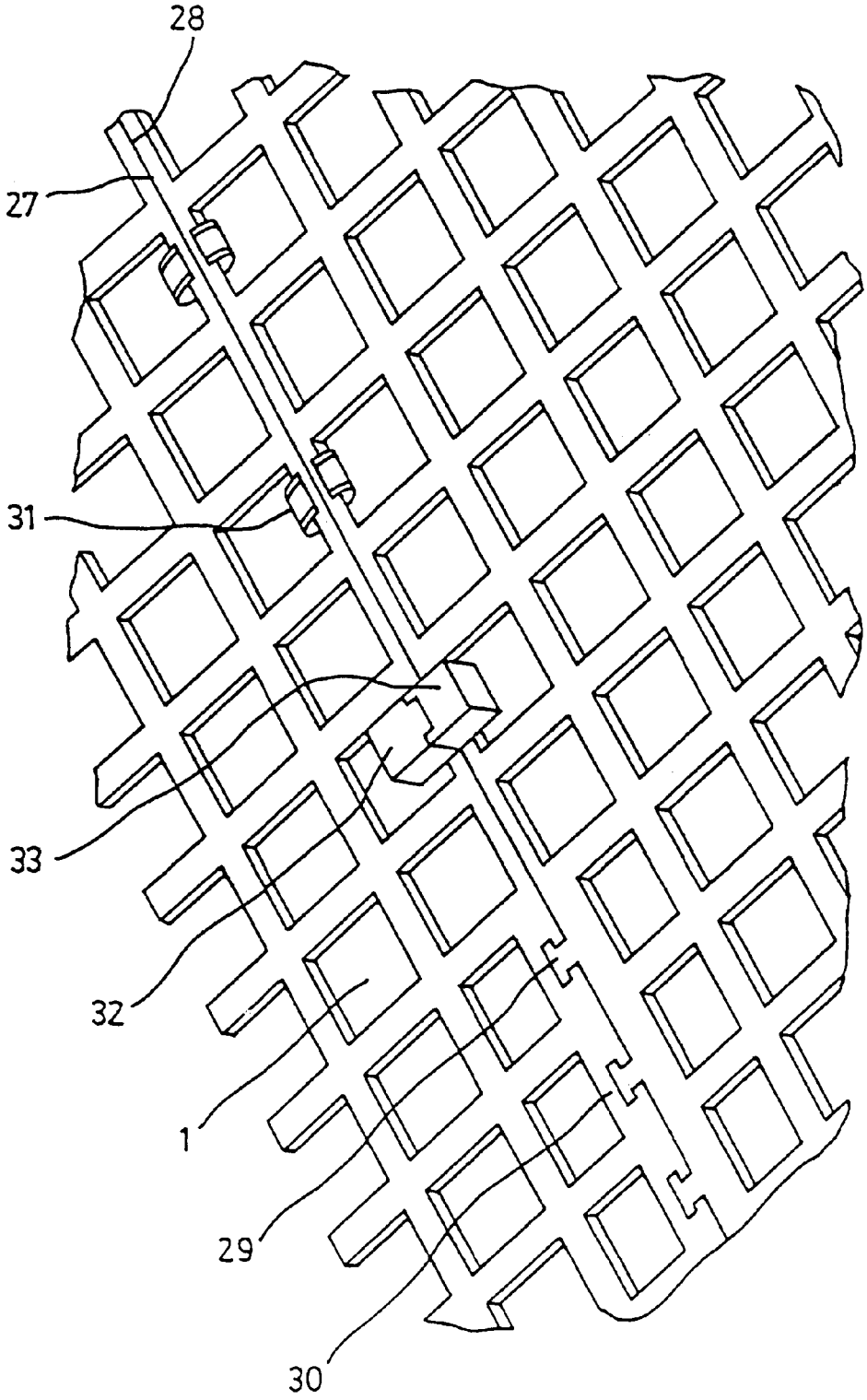
FIG. 9 shows an example of the connection of adjacent support gratings.

Finally, in the case of a supporting structure 1 according to FIG. 1, FIG. 9 shows the mutual positive-locking connection of supporting structures laid side by side. For this, with regard to the edges 27, 28 of adjacent supporting structures 1, one of the edges 28 is provided with T-shaped projections 29 and the other edge 27 with slots 30 matching the projections 29. The same principle is embodied with the aid of formed parts 32, 33 which in this case are used to form the gap at the same time.

A further possibility can be provided by for example by clips 31 fitted from below, which in this case must be designed so that they do not project upwards through the surface formed by the supporting structure 1.

The edges 27 and 28 can also be connected together by other methods, e.g., adhesive bonding or thermal treatment.

Design forms of the invention are described above by way of example, by which its scope however cannot be exhaustively described. Therefore the design characteristics explained in detail can also be combined with each other in another form. In particular the individual designs can be varied so that adaptations to each desired stone laying patterns or different stone sizes can be made without the objective being abandoned, the stones additionally being sufficiently supported against tilting movements and if necessary slewing movements.

The embodiments of the invention in which an exclusive property or privilege is claimed are defined as follows:

1. A method of anchoring outdoor traffic areas provided with cobblestones or paving stones, said areas comprising a bed of sand and/or grit, the method comprising:

a) laying a supporting structure on said bed of sand and/or grit; and b) laying said stones on said supporting structure said supporting structure comprising a lattice formed of intersecting elongate elements, said lattice having a unitary structure;

said stones being provided with recesses that are able to engage said intersecting elements and wherein said stones are laid over said supporting structure so that said recesses engage said intersecting elements.

2. The method of claim 1 wherein the stones are laid over the intersections of said elongate elements.

3. An anchoring system for paving elements, said paving elements being designed for over lying a bed of sand and/or grit, said system comprising a supporting structure that is laid over said bed of sand and/or grit, wherein said supporting structure comprises a lattice formed of intersecting elongate elements, said lattice having a unitary structure and wherein said paving elements are laid above said supporting structure;

said paving elements including recesses that are able to engage said intersecting elements.

4. The anchoring system of claim 3 wherein said elongate elements intersect generally perpendicularly.

5. The anchoring system of claim 4 wherein said recesses on said paving elements are generally cruciform.

6. The anchoring system of claim 3 wherein said supporting structure is provided with first formed parts, on an upper surface thereof, for separating adjacent stones to thereby form gaps there between.

7. The anchoring system of claim 5 wherein said first formed parts are integral with said supporting structure.

8. The anchoring system of claim 3 wherein second formed parts are provided integral with said supporting structure, said second formed parts being provided on a lower surface of said supporting structure for anchoring said supporting structure in said bed of sand or grit.

9. The anchoring system of claim 3 wherein adjacent supporting structures are connected together with locking devices.

* * * * *